US009259781B2

(12) United States Patent
Mohr

(10) Patent No.: US 9,259,781 B2
(45) Date of Patent: Feb. 16, 2016

(54) CASE CORROSION-RESISTANT LINERS IN NOZZLES AND CASE BODIES TO ELIMINATE OVERLAYS

(71) Applicant: Dresser-Rand Company, Olean, NY (US)

(72) Inventor: Byron L. Mohr, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 89 days.

(21) Appl. No.: 14/100,551

(22) Filed: Dec. 9, 2013

(65) Prior Publication Data

US 2014/0190649 A1 Jul. 10, 2014

Related U.S. Application Data

(60) Provisional application No. 61/737,214, filed on Dec. 14, 2012.

(51) Int. Cl.

| | |
|---|---|
| ***B22D 25/02*** | (2006.01) |
| ***B22C 9/02*** | (2006.01) |
| ***B22D 19/16*** | (2006.01) |

(52) U.S. Cl.
CPC .. *B22D 19/16* (2013.01); *B22C 9/02* (2013.01)

(58) Field of Classification Search
CPC ..... B22D 25/02; B22D 19/16; B22C 9/02
USPC ..... 164/15, 30, 44, 94
See application file for complete search history.

(56) References Cited

U.S. PATENT DOCUMENTS

| | | | | | |
|---|---|---|---|---|---|
| 3,173,451 | A | * | 3/1965 | Slayter | 138/145 |
| 3,373,484 | A | * | 3/1968 | Larson et al. | 148/522 |
| 3,433,284 | A | * | 3/1969 | Webbere et al. | 164/111 |
| 5,215,141 | A | * | 6/1993 | Kuhn et al. | 164/457 |
| 5,217,059 | A | * | 6/1993 | Kuhn et al. | 164/132 |
| 5,617,773 | A | * | 4/1997 | Craft et al. | 92/171.1 |

* cited by examiner

*Primary Examiner* — Kevin P Kerns
(74) *Attorney, Agent, or Firm* — Edmonds & Nolte, PC

(57) ABSTRACT

A method for protecting a turbomachine from corrosion may include creating a first sand mold in a drag of a casting flask, coupling a cope of the casting flask to the drag, removing the runner pin and the at least one riser pin from the cope to expose a runner and at least one riser, respectively, and pouring a molten first material in the runner to cast a first component of the turbomachine. The method may further include removing the first sand mold, creating a second sand mold utilizing the first component in the drag, coupling the cope to the drag, removing the runner pin and the at least one riser pin from the cope to expose a runner and at least one riser, respectively, and pouring a molten second material in the runner to cast a second component of the turbomachine integral with the first component.

17 Claims, 9 Drawing Sheets

CASE CORROSION-RESISTANT LINERS IN NOZZLES AND CASE BODIES TO ELIMINATE OVERLAYS

CROSS REFERENCE TO RELATED APPLICATIONS

This application claims priority to U.S. Provisional Patent Application having Ser. No. 61/737,214, which was filed Dec. 14, 2012. This priority application is hereby incorporated by reference in its entirety into the present application to the extent consistent with the present application.

BACKGROUND

Various industrial processes and equipment operate at high temperature and/or pressure, and do so in environments containing corrosive fluids. In these environments, typical iron and steel equipment surfaces can be degraded by corrosive reactions with elements of the corrosive fluids, which can include, for example, carbon dioxide, hydrogen sulfide, chloride ions, and the like.

One way to avoid corrosion is to provide a protective liner that separates the corrosion-susceptible equipment surfaces from the corrosive fluids. Certification standards, such as those set by the National Association of Corrosion Engineers (NACE), typically require a bond between the protective liner and the equipment surface. Accordingly, mechanical fits fall short of these standards; however, bonding the protective liner to the equipment surfaces such that the bond is essentially free of voids, oxide films, and/or discontinuities, while still having a long corrosion-protecting life and being compliant with certification standards, may present a challenge. This challenge may be made more difficult when it is desired to create and protect generally cylindrical equipment housings for the turbomachines.

One way to affix a corrosion-resistant protective liner to a corrosion-susceptible surface is known as explosive cladding. In explosive cladding, the corrosive-resistant liner is placed on the surface to be protected of the corrosion-susceptible equipment, and then an explosion is set off proximate thereto, typically with both the liner and the equipment disposed underwater. The explosion plasticizes the surfaces of both the equipment and the liner and produces a bond therebetween. Explosive cladding, however, is typically limited in application to flat surfaces. Accordingly, if a generally cylindrical equipment housing is desired, a flat plate generally must be clad, which is subsequently rolled and welded. This additional working adds cost and time to the bonding process. Furthermore, explosive cladding requires careful planning, specialized equipment, and ballistics expertise to deal with dangerous explosive devices.

Another way to create a protective liner is to provide a weld overlay. In this process, a weld material is deposited in a layer on the equipment surface, for example, an inner surface of a nozzle body, and the process is repeated many times until a desired thickness is reached. This process, however, is time-consuming and expensive both in terms of labor and equipment. Furthermore, this process allows for potential weld defects, which, if present, may require additional reworking of the welding process, further increasing the expense and time associated with this process.

What is needed, therefore, is a process in which a corrosion-resistant protective liner is casted on an equipment surface, for example, an inner surface of a nozzle body, with the casting process generally minimizing the potential for defects in the bond between the corrosion-resistant protective liner and the equipment surface.

SUMMARY

Embodiments of the disclosure may provide a method for protecting a turbomachine from corrosion. The method may include casting a first component of the turbomachine, and using the first component to cast a second component of the turbomachine integral with the first component. One of the first component and the second component may be corrosion resistant.

Embodiments of the disclosure may provide another method for protecting a turbomachine from corrosion. The method may include creating a first sand mold in a drag of a casting flask. The first sand mold may define a first in-gate and a hollow region. The method may further include pouring a molten first material in the first sand mold to cast a first component of the turbomachine, and creating a second sand mold in the drag of the casting flask. The second sand mold may utilize the first component. Further, the method may include pouring a molten second material in the second sand mold to cast a second component of the turbomachine integral with the first component. One of the first component and the second component may be corrosion-resistant.

Embodiments of the disclosure may provide another method for protecting a turbomachine from corrosion. The method may include creating a first sand mold in a drag of a casting flask, and coupling a cope of the casting flask to the drag. The cope may include a runner pin and at least one riser pin. The method may further include removing the runner pin and the at least one riser pin to expose a runner and at least one riser, respectively, pouring a molten first material in the runner to cast a first component of the turbomachine, and removing the first sand mold and creating a second sand mold in the drag. The second sand mold may utilize the first component. The method may still further include coupling the cope of the casting flask to the drag, and removing the runner pin and the at least one riser pin to expose a runner and at least one riser, respectively. Additionally, the method may include pouring a molten second material in the runner to cast a second component of the turbomachine integral with the first component. One of the first component and the second component may be corrosion-resistant

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
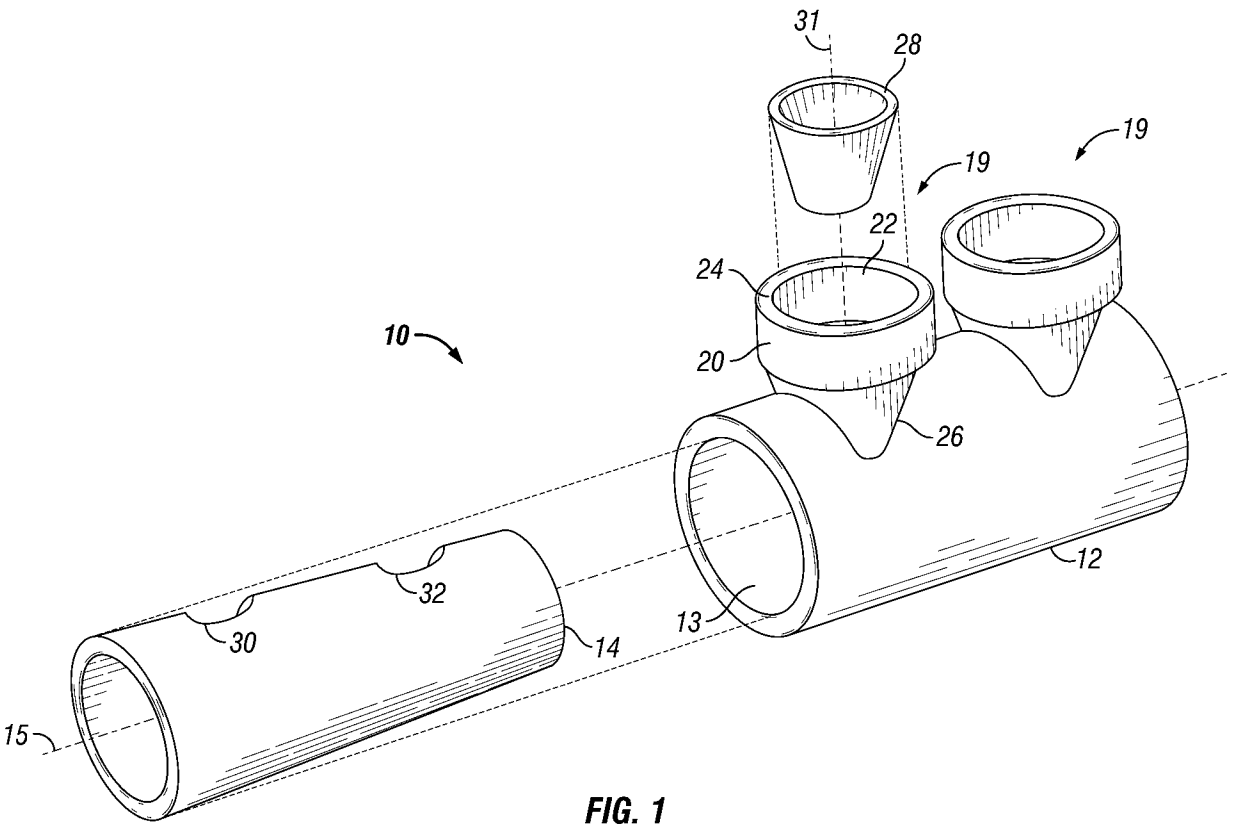
FIG. 1 illustrates a partial exploded view of an exemplary turbomachine housing, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a partial exploded view of an exemplary turbomachine housing 10. The housing 10 may include a casing 12, which may define a central bore 13 therein. The casing 12 may be constructed of any suitable material, such as carbon steel, alloy steel, or the like. Further, the casing 12 may be of a thickness sufficient to allow the casing 12 to contain fluid-processing equipment (not shown), such as blades, impellers, stators, combinations thereof, or the like, which may process corrosive fluids at a high pressure. In various exemplary embodiments, the fluid processing equipment may operate at pressures within the casing 12 ranging from a low of about 300 psi, about 1,000 psi, or about 3,000 psi to a high of about 12,000 psi, about 15,000 psi, or about 17,000 psi or greater, although such range is merely exemplary and higher or lower pressure casings may be employed according to this disclosure.

The casing 12 may be susceptible to corrosion, and therefore, the housing 10 may include a corrosion-resistant liner 14. In various exemplary embodiments, the corrosion-resistant liner 14 may or may not provide additional structural support for the casing 12. The corrosion-resistant liner 14 is constructed of materials designed to resist degradation in the fluidic environment of the housing 10. For example, the corrosion-resistant liner 14 may be or include one or more stainless steel alloys, one or more nickel alloys, one or more cobalt alloys, titanium, zirconium, combinations thereof, or like materials. In various exemplary embodiments, the material of which the corrosion-resistant liner 14 is constructed may vary, for example, according to the intended application. Furthermore, the casing 12 and the corrosion-resistant liner 14 may both be substantially radial or annular in cross-section, and may be concentric, thereby defining a central axis 15 therein.

The housing 10 may also include one or more nozzles 19. Although two nozzles 19 are shown, additional nozzles 19 may be employed. For example, a back-to-back compressor or a compressor with one or more inter-stage sidestreams may require additional nozzles 19. Similarly, various turbines, pumps, and other turbomachines of various configurations known in the art may require additional or fewer nozzles 19.

One or more of the nozzles 19 may include a nozzle body 20, which may define a nozzle bore 22 therein. The nozzle bore 22 may extend from a first nozzle end 24 of the nozzle body 20 to a second nozzle end 26 of the nozzle body 20. In an exemplary embodiment, either or both of the first and second nozzle ends 24, 26 may include a flange for attaching the nozzle 19 to the casing 12. The nozzle body 20 may be coupled to the casing 12 proximal the second nozzle end 26 using any suitable coupling method, such as welding, brazing, bonding, casting, forging, fastening, combinations thereof, or the like.

The nozzles 19 may be made of a material that shares the corrosion-susceptible properties of the casing 12. For example, the nozzle body 20 may be made of the same material as the casing 12. Accordingly, the nozzle body 20 may include a corrosion-resistant nozzle liner 28, which may be disposed at least partially in the nozzle body 20, as shown. The corrosion-resistant nozzle liner 28 may be constructed of any suitably corrosion-resistant material, which may vary in different embodiments, for example, according to the intended application. In various exemplary embodiments, the corrosion-resistant nozzle liner 28 may be or include one or more stainless steel alloys, one or more nickel alloys, one or more cobalt alloys, titanium, zirconium, combinations thereof, or the like. Moreover, it will be appreciated that in one or more embodiments either, both, or any (in embodiments having more than two nozzles 19) of the nozzles 19 may include a corrosion-resistant nozzle liner 28. Furthermore, in an exemplary embodiment, the nozzles 19 and the corrosion-resistant nozzle liner 28 may be generally annular in cross-section, thereby defining a nozzle axis 31 therethrough. It will be appreciated that any combination of components having corrosion-resistant liners is within the scope of this disclosure. For example, the casing 12 may be provided with corrosion-resistant liner 14, while the corrosion-resistant nozzle liner 28 may be omitted, or vice versa.

In addition to being corrosion-resistant, the material of the corrosion-resistant nozzle liner 28 and/or the corrosion-resistant liner 14 may also exhibit pressure-containing properties. As known in the art, pressures in turbomachine applications may range, for example, anywhere from about 1,200 psi to about 15,000 psi. In an example embodiment, to withstand the extreme pressures for any specific turbomachine application, the minimum thickness of the corrosion-resistant nozzle liner 28 and/or the corrosion-resistant liner 14 may be calculated so as to manufacture a liner 14, 28 that meets and/or exceeds the thickness requirements. For example, if the thickness of the corrosion-resistant nozzle liner 28 and/or the corrosion-resistant liner 14 may be calculated as T units, the corrosion-resistant nozzle liner 28 and/or the corrosion-resistant liner 14 may be manufactured with a thickness of ($T+\Delta T$) units, wherein $\Delta T$ indicates a thickness in addition to the calculated minimum thickness. In another example embodiment, the thickness of the nozzle 19 and/or the thickness of the casing 12 may also be considered when calculating the additional thickness $\Delta T$.

Referring again to the corrosion-resistant liner 14, therein may be defined axially-spaced, radially-extending apertures 30, 32. The casing 12 may similarly provide axially-spaced, radially-extending apertures therein, with each of the nozzles 19 being disposed in a separate one of the axially-spaced, radially-extending apertures of the casing 12. The apertures 30, 32 of the corrosion-resistant liner 14 may be aligned with the apertures of the casing 12 to provide fluid communication from inside of the corrosion-resistant liner 14 therethrough, through the casing 12, and into and/or from the nozzles 19. The apertures 30, 32 may be cut or otherwise formed in the corrosion-resistant liner 14 prior to or after inserting the corrosion-resistant liner 14 into the casing 12.

Although the corrosion-resistant nozzle liner 28 is shown separate from the nozzle 19, it should be appreciated that this is only for the sake of explanation, and that the corrosion-resistant nozzle liner 28 is casted integral with the nozzle 19. The exemplary process of casting the nozzle 19 and the corrosion-resistant nozzle liner 28 integral with the nozzle 19 is described below with reference to FIGS. 2-16. Further, it should be noted that the corrosion-resistant liner 14 may also be integral with the casing 12 and may be formed using the process described below.

Figure 2:
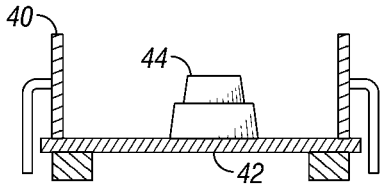
FIGS. 2-8 illustrate a process of manufacturing a nozzle of the exemplary turbomachine of FIG. 1, according to one or more embodiments disclosed.

FIGS. 2-8 illustrate a process of manufacturing a nozzle of the exemplary turbomachine of FIG. 1, according to one or more embodiments disclosed. As illustrated in FIG. 2, a drag 40 of a two-part casting flask is placed upside down on a molding board 42 and a pattern 44 (for example, a wooden pattern, a ceramic pattern, or the like) may be placed substantially in the center of the drag 40. Talcum powder may be dusted over the pattern 44 to aid in the removal (see below) of the pattern 44. The shape of the pattern 44 coincides with the shape of the nozzle 19. The pattern 44 is placed with its broader end in contact with the molding board 42, as shown in FIG. 2.

Figure 3:
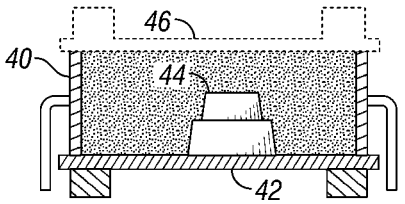
Figure 4:
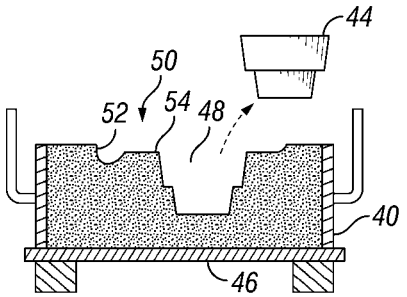

As illustrated in FIG. 3, the drag 40 is filled with sand up to its top opening such that the pattern 44 is completely buried in sand. A bottom board 46 is then placed over the top opening of the drag 40. A small amount of pressure may be applied to the bottom board 46 to ensure that the sand is tightly packed in the drag 40. Alternatively, the assembly including the drag 40, the molding board 42, and the bottom board 46 may be rammed with a wooden wedge, or mechanically vibrated to pack the sand down. As shown in FIG. 4, the assembly including the drag 40, the molding board 42, and the bottom board 46 is flipped over. The molding board 42 and the pattern 44 are removed resulting in a sand mold exhibiting a hollow 48 formed as a result of removing the pattern 44. An in-gate 50 is carved in the sand mold. The in-gate 50 may include a depression 52 on one side of the hollow 48 and a passageway 54 around and on both sides of the hollow 48. The passageway 54 may also be in communicative contact with the depression 52.

A first core 56 is fixed substantially in the center of the hollow 48 formed by the pattern 44. The first core 56 may create the outer diameter (OD) surfaces of the corrosion-resistant nozzle liner 28 to be formed. The first core 56 may have a body in a shape of a conical frustum. The top and bottom ends may have protrusions of suitable shape to stably fix the first core 56 in the hollow 48. In the exemplary embodiment illustrated in FIG. 5, the first core 56 is placed in the hollow 48 such that the narrow end of the first core 56 is partially in the sand.

Figure 5:
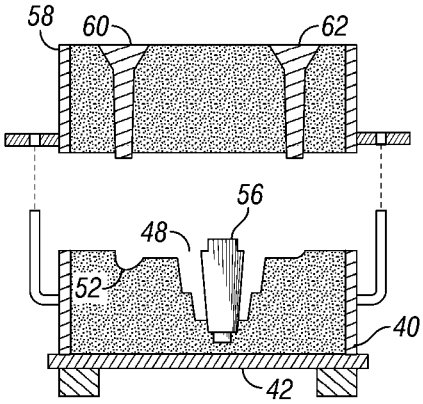
Figure 6:
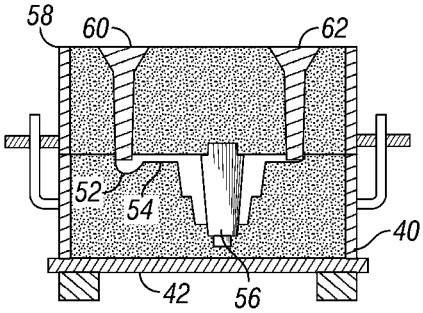
Figure 7:
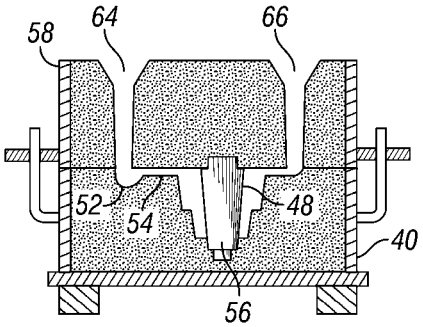

As illustrated in FIG. 5, a cope 58 including dowels (or pins) tightly packed in sand is placed over the drag 40. The dowels (or pins) make holes for a runner (also referred to as a sprue) and one or more risers (a riser is a reservoir built to prevent cavities due to shrinkage of the molten metal). FIG. 5 illustrates a runner pin 60 and a riser pin 62 of a plurality of riser pins (not shown). Referring to FIG. 6, it should be noted that the runner pin 60 is placed in the cope 58 such that the runner pin 60 is over the depression 52 of the in-gate 50 when the cope 58 is placed over the drag 40. The cope 58 and drag 40 are bolted to each other and the runner and riser pins 60, 62 are removed exposing the in-gate 50 and creating the runner 64 and the riser 66, as shown in FIG. 7.

Figure 8:
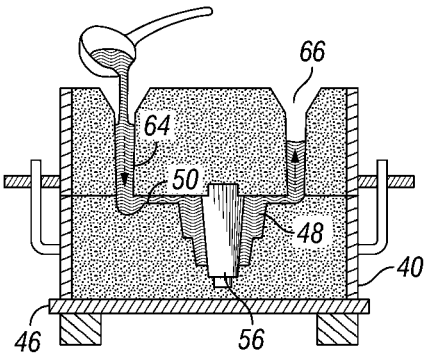

As illustrated in FIG. 8, molten material (for example, carbon steel, alloy steel, or the like) used in constructing the nozzle 19 is poured in the runner 64. The molten material may fill the hollow 48 and the riser 66. Once the molten material has solidified, the casting flask can then be separated, the first core 56 and the sand can be removed, and the solid material formed in the passageway 54 may be removed to reveal the nozzle 19. A cross-sectional view of such a manufactured nozzle 19 is illustrated in FIG. 9.

Figure 9:
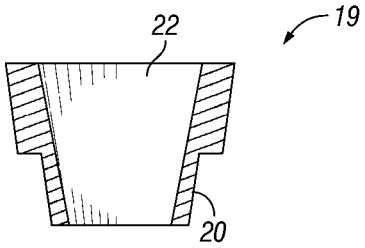
FIG. 9 illustrates a cross-sectional view of a nozzle manufactured from the process illustrated in FIGS. 2-8, according to one or more embodiments disclosed.
Figure 10:
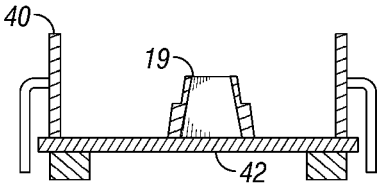
FIGS. 10-15 illustrate a process of manufacturing a corrosion-resistant liner in the nozzle illustrated in FIG. 9, according to one or more embodiments disclosed.
Figure 11:
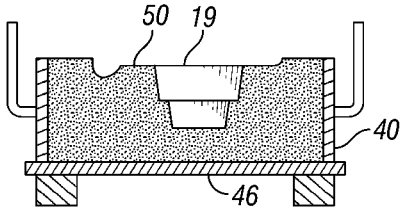
Figure 12:
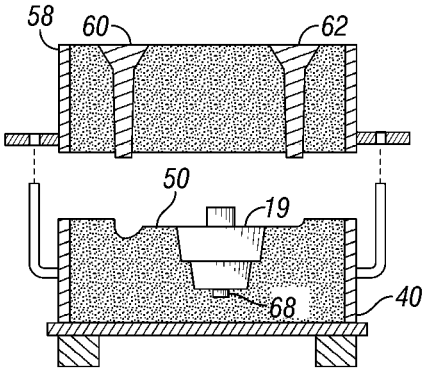

FIGS. 10-15 illustrate a process of manufacturing the corrosion-resistant nozzle liner 28 in the nozzle 19 illustrated in FIG. 9, according to one or more embodiments disclosed. The casting flask may be cleared of the sand used in the previous steps prior to proceeding with manufacturing of the corrosion-resistant liner. Referring to FIG. 10, the nozzle 19 obtained from the above steps is placed with its broader opening in contact with the molding board 42 of the drag 40. The process described above with respect to FIG. 3 is repeated. Then, as described with respect to FIG. 4, the assembly including the drag 40, the molding board 42, and the bottom board 46 is flipped over. The molding board 42 is removed. However, the nozzle 19 is not removed from the sand. As shown in FIG. 11, the in-gate 50 is carved in the sand. The sand in the nozzle bore 22 of the nozzle 19 is removed and a second core 68 is placed in the nozzle 19, as illustrated in FIG. 12. The second core 68 (see FIG. 15) may have a substantially cylindrical body with protrusions on one or both ends. The protrusion(s) may stably fix the second core 68 in the sand below the nozzle 19. The second core 68 may create the inner diameter (ID) surface of the corrosion-resistant nozzle liner 28 of the nozzle 19.

Figure 13:
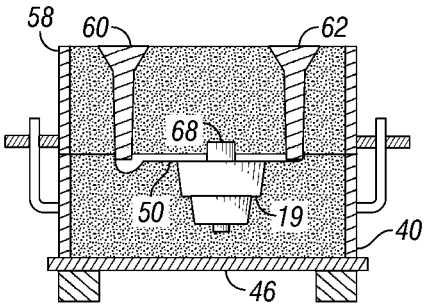

The cope 58 including the runner pin 60 and a riser pin 62 (of a plurality of riser pins) in tightly packed sand is placed over the drag 40 and bolted thereto, as illustrated in FIG. 13.

Figure 14:
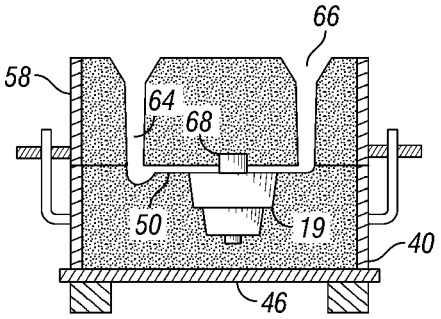

As shown in FIG. 14, the runner and riser pins 60, 62 are removed exposing the in-gate 50 and creating the runner 64 and the riser 66.

Figure 15:
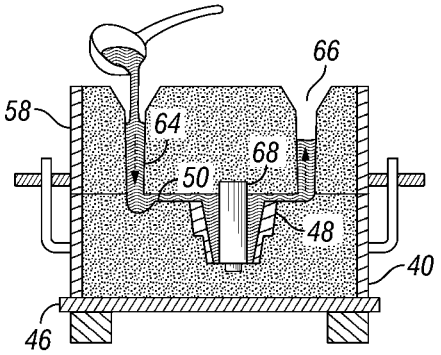
Figure 16:
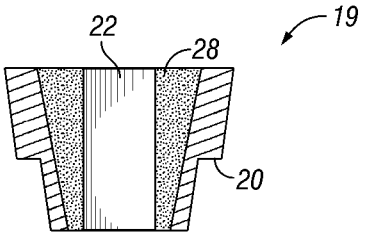
FIG. 16 illustrates a cross-sectional view of a nozzle with an integrated corrosion-resistant liner manufactured from the process illustrated in FIGS. 10-15, according to one or more embodiments disclosed.

As illustrated in FIG. 15, molten material used for constructing the corrosion-resistant nozzle liner 28 is poured in the runner 64. The molten material occupies the space around the second core 68 in the nozzle 19. As mentioned above, once the material has solidified, the casting flask can then be separated, the second core 68 and the sand may be removed, and the solid corrosion-resistant material formed in the passageway 54 may be removed to reveal the nozzle 19 with the corrosion-resistant nozzle liner 28 integrally formed as the inner surface of the nozzle 19. A cross-sectional view of such a manufactured nozzle 19 is illustrated in FIG. 16.

In an example embodiment, instead of using the nozzle 19 to cast the corrosion-resistant nozzle liner 28 integral therewith, the corrosion-resistant nozzle liner 28 may be cast prior to casting the nozzle 19 and may be used to cast the nozzle 19 integral therewith. For example, the process illustrated in FIGS. 2-8 may be used to cast the corrosion-resistant nozzle liner 28. In the process illustrated in FIGS. 10-15, the corrosion-resistant nozzle liner 28 may be used to cast the nozzle 19 integral with the corrosion-resistant nozzle liner 28 on an outer surface of the corrosion-resistant nozzle liner 28.

When the corrosion-resistant nozzle liner 28 is cast prior to casting the nozzle 19, the process illustrated in FIGS. 2-8 may remain substantially unchanged, except that the process may be used to cast the corrosion-resistant nozzle liner 28 instead of the nozzle 19. However, some modifications may be required for the process illustrated FIGS. 10-15. For example, referring to FIG. 12, the drag 40 may include the corrosion-resistant nozzle liner 28 obtained from the process in FIGS. 2-8 instead of the nozzle 19. Sand may be packed in the corrosion-resistant nozzle liner 28 instead of the second core 68. The sand around the corrosion-resistant nozzle liner 28 may be removed to create a space around the corrosion-resistant nozzle liner 28. The space may have a shape of the outer surface of the nozzle 19. When molten nozzle material is poured (FIG. 15), the molten nozzle material may occupy the space around the corrosion-resistant nozzle liner 28. Once the nozzle material has solidified, the casting flask may be separated and the sand may be removed to reveal the nozzle 19 with the corrosion-resistant nozzle liner 28 integrally on the inner surface of the nozzle 19.

Figure 17:
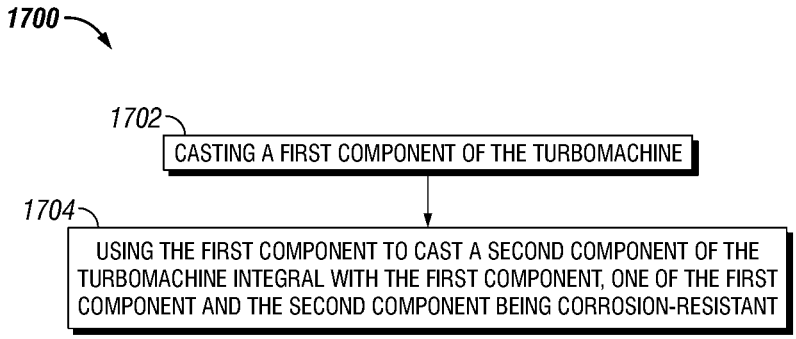
FIG. 17 illustrates a flowchart of a method for protecting a turbomachine from corrosion, according to one or more embodiments disclosed.

FIG. 17 illustrates a flowchart of a method 1700 for protecting a turbomachine from corrosion, according to one or more embodiments disclosed. The method 1700 may include casting a first component of the turbomachine, as at 1702, and using the first component to cast a second component of the turbo machine integral with the first component, as at 1704. One of the first component and the second component may be corrosion resistant.

Figure 18:
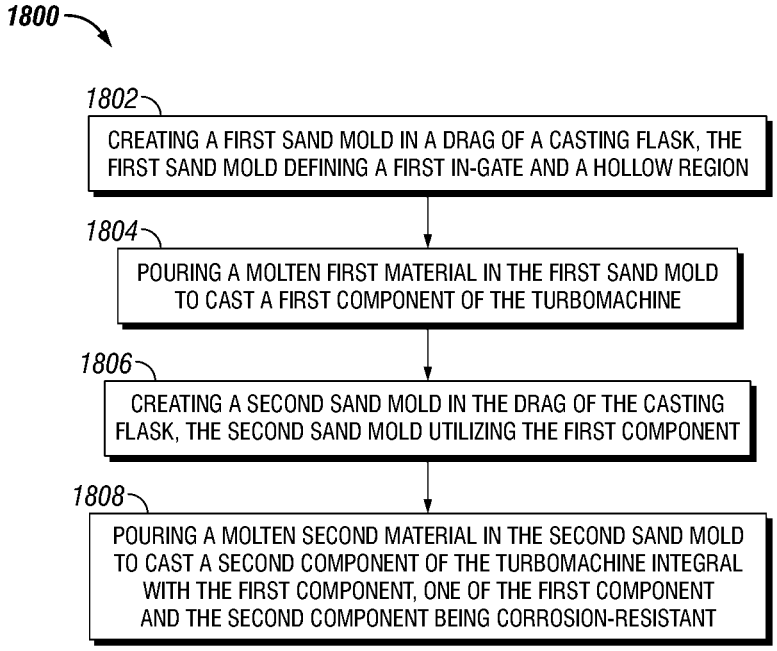
FIG. 18 illustrates a flowchart of a method for protecting a turbomachine from corrosion, according to one or more embodiments disclosed.

FIG. 18 illustrates a method 1800 for protecting a turbomachine from corrosion, according to one or more embodiments disclosed. The method 1800 may include creating a first sand mold in a drag of a casting flask, as at 1802. The first sand mold may define a first in-gate and a hollow region. The method 1800 may further include pouring a molten first material in the first sand mold to cast a first component of the turbomachine, as at 1804, and creating a second sand mold in the drag of the casting flask, as at 1806. The second sand mold may utilize the first component. Further, the method 1800 may include pouring a molten second material in the second sand mold to cast a second component of the turbomachine integral with the first component, as at 1808. One of the first component and the second component maybe corrosion-resistant.

Figure 19A:
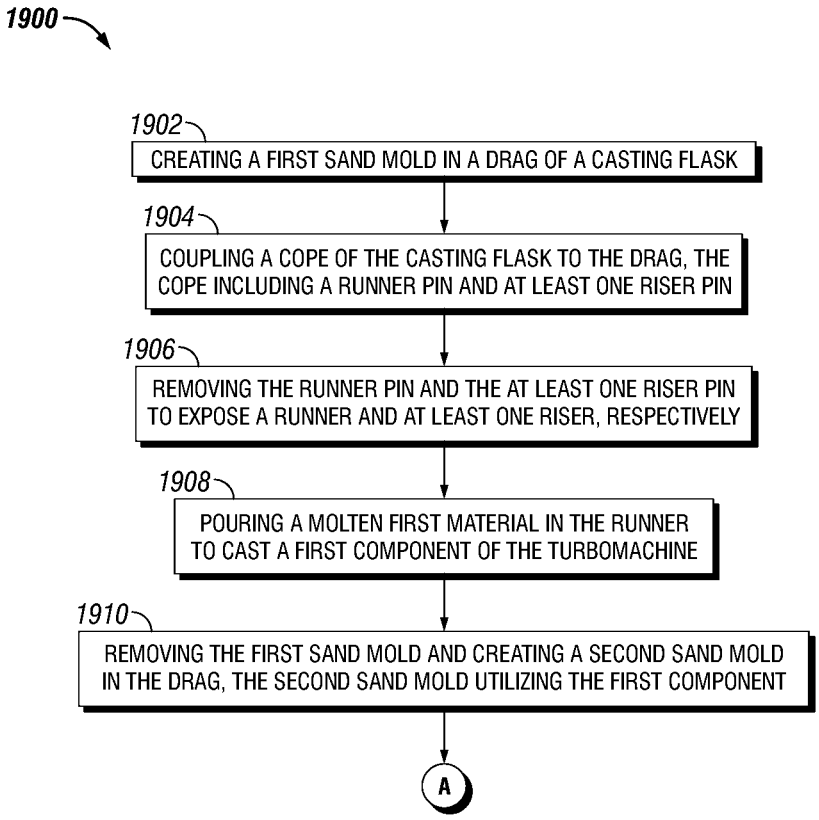
FIGS. 19A and 19B illustrate a flowchart of another method for protecting a turbomachine from corrosion, according to one or more embodiments disclosed.
Figure 19B:
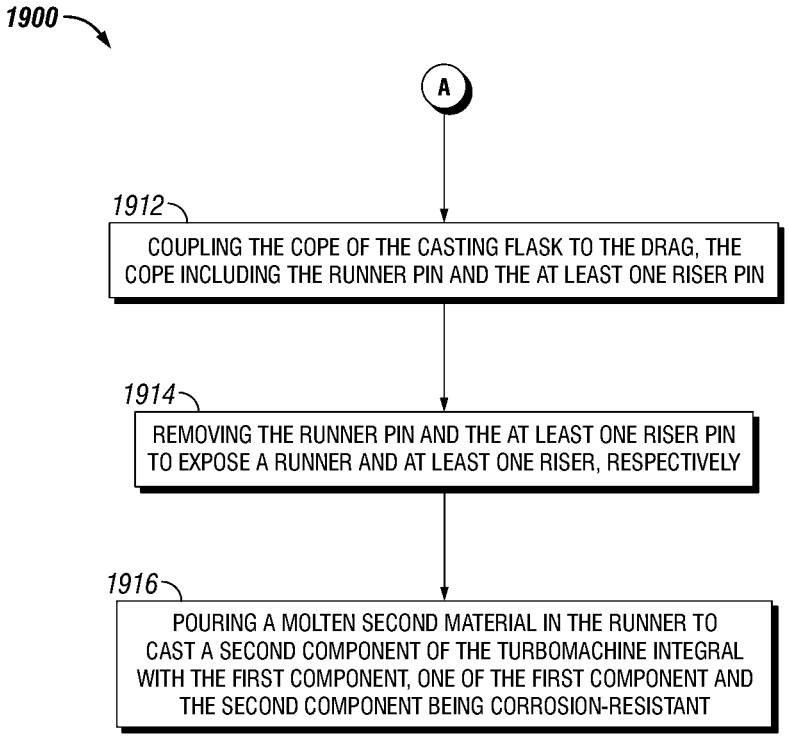

FIGS. 19A and 19B illustrate another method 1900 for protecting a turbomachine from corrosion, according to one or more embodiments disclosed. The method 1900 may include creating a first sand mold in a drag of a casting flask, as at 1902, and coupling a cope of the casting flask to the drag, as at 1904. The cope may include a runner pin and at least one riser pin. The method 1900 may further include removing the runner pin and the at least one riser pin to expose a runner and at least one riser, respectively, as at 1906, pouring molten first material in the runner to cast a first component of the turbomachine, as at 1908, and removing the first sand mold and creating a second sand mold in the drag, as at 1910. The second sand mold may utilize the first component. The method 1900 may still further include coupling the cope of the casting flask to the drag, as at 1912, and removing the runner pin and the at least one riser pin to expose a runner and at least one riser, respectively, as at 1914. Additionally, the method 1900 may include pouring a molten second material in the runner to cast a second component of the turbomachine integral with the first component, as at 1916. One of the first component and the second component may be corrosion-resistant.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

I claim:

1. A method for protecting a turbomachine from corrosion, comprising:

casting a nozzle of the turbomachine; and using the nozzle to cast a corrosion-resistant liner of the turbomachine integral with the nozzle, one of the nozzle and the corrosion-resistant liner being corrosion resistant, wherein casting the nozzle comprises:

creating a first sand mold in a drag of a casting flask, the first sand mold defining a first in-gate and a hollow region, wherein creating the first sand mold comprises:

placing the drag upside-down on a molding board;

placing a pattern having dimensions of the nozzle on the molding board:

filling the drag with sand such that the pattern is buried in the sand;

placing a bottom board on the drag;

flipping over an assembly including the molding board, the drag, and the bottom board; and removing the pattern;

coupling a cope of the casting flask to the drag, the cope including a runner pin and at least one riser pin;

removing the runner pin and the at least one riser pin to expose a first runner and at least one first riser, respectively; and pouring a molten nozzle material in the first runner to cast the nozzle.

2. The method of claim 1, wherein the first in-gate defines a first depression and a first passageway, and wherein the cope is coupled to the drag such that the first runner aligns with the first depression and the at least one first riser aligns with the first passageway.

3. The method of claim 1, further comprising:

disposing a first core in the hollow region of the first sand mold, wherein the molten nozzle material occupies a space between the first core and the first sand mold.

4. The method of claim 3, wherein the first core defines an outer surface of the corrosion-resistant liner.

5. The method of claim 1, wherein the hollow region is in a shape of the nozzle.

6. The method of claim 1, wherein casting the corrosion-resistant liner comprises:

creating a second sand mold in the drag of the casting flask, the second sand mold including the nozzle and defining a second in-gate;

coupling the cope of the casting flask to the drag, the cope including the runner pin and the at least one riser pin;

removing the runner pin and the at least one riser pin to expose a second runner and at least one second riser, respectively; and pouring molten corrosion-resistant liner material in the second runner to cast the corrosion-resistant liner integral with the nozzle.

7. The method of claim 6, further comprising:

disposing a first core in the nozzle, wherein the molten corrosion-resistant liner material occupies a space formed between the nozzle and the first core.

8. The method of claim 7, wherein the first core defines an inner surface of the corrosion-resistant liner.

9. The method of claim 6, wherein the first in-gate defines a first depression and a first passageway, and wherein the cope is coupled to the drag such that the first runner aligns with the first depression and the at least one first riser aligns with the first passageway.

10. The method of claim 1, wherein the corrosion-resistant liner comprises one or more stainless steel alloys, one or more nickel alloys, one or more cobalt alloys, titanium, zirconium, or combinations thereof.

11. The method of claim 1, wherein the nozzle comprises carbon steel or alloy steel.

12. A method for protecting a turbomachine from corrosion, comprising:

creating a first sand mold in a drag of a casting flask, the first sand mold defining a first in-gate and a hollow region;

pouring a molten first material in the first sand mold to cast a first component of the turbomachine;

creating a second sand mold in the drag of the casting flask, the second sand mold utilizing the first component; and pouring a molten second material in the second sand mold to cast a second component of the turbomachine integral with the first component, one of the first component and the second component being corrosion-resistant, wherein the molten first material is a molten nozzle material, the first component is a nozzle of the turbomachine, a molten second material is a molten corrosion-resistant liner material, and the second component is a corrosion-resistant liner, and wherein creating the first sand mold comprises:

placing the drag upside-down on a molding board;

placing a pattern having dimensions of the nozzle on the molding board;

filling the drag with sand such that the pattern is buried in the sand;

placing a bottom board on the drag;

flipping over an assembly including the molding board, the drag, and the bottom board; and removing the pattern.

13. The method of claim 12, further comprising:

coupling a cope of the casting flask to the drag, the cope including a runner pin and at least one riser pin; and removing the runner pin and the at least one riser pin to expose a runner and at least one riser, respectively.

14. The method of claim 13, wherein:

each of the first sand mold and the second sand mold defines a first in-gate and a second in-gate, respectively, each of the first in-gate and the second in-gate defining a depression and a passageway; and the cope is coupled to the drag such that the runner aligns with the depression and the at least one riser aligns with the passageway.

15. The method of claim 12, wherein creating the second sand mold comprises:

placing the drag upside-down on the molding board;

placing the nozzle on the molding board;

filling the drag with sand such that the cast nozzle is buried in the sand;

placing the bottom board on the drag; and flipping over the assembly including the molding board, the drag, and the bottom board.

16. A method for protecting a turbomachine from corrosion, comprising:

creating a first sand mold in a drag of a casting flask;

coupling a cope of the casting flask to the drag, the cope including a runner pin and at least one riser pin;

removing the runner pin and the at least one riser pin to expose a first runner and at least one first riser, respectively;

pouring a molten first material in the first runner to cast a first component of the turbomachine;

removing the first sand mold and creating a second sand mold in the drag, the second sand mold utilizing the first component;

coupling the cope of the casting flask to the drag, the cope including the runner pin and the at least one riser pin;

removing the runner pin and the at least one riser pin to expose a second runner and at least one second riser, respectively; and pouring a molten second material in the second runner to cast a second component of the turbomachine integral with the first component, one of the first component and the second component being corrosion-resistant, wherein the molten first material is a molten nozzle material, the first component is a nozzle, a molten second material is a molten corrosion-resistant liner material, and the second component is a corrosion-resistant liner, and wherein creating the first sand mold comprises:

placing the drag upside-down on a molding board;

placing a pattern having dimensions of the nozzle on the molding board;

filling the drag with sand such that the pattern is buried in the sand;

placing a bottom board on the drag;

flipping over an assembly including the molding board, the drag, and the bottom board; and removing the pattern and carving a first in-gate.

17. The method of claim 16, wherein creating the second sand mold comprises:

placing the drag upside-down on the molding board;

placing the nozzle on the molding board;

filling the drag with sand such that the cast nozzle is buried in the sand;

placing the bottom board on the drag;

flipping over the assembly including the molding board, the drag, and the bottom board; and carving a second in-gate.

* * * * *